US006224231B1

(12) United States Patent
Personius

(10) Patent No.: US 6,224,231 B1
(45) Date of Patent: May 1, 2001

(54) FESTIVE DECORATIVE LIGHTING SYSTEM FOR TREES

(76) Inventor: James M. Personius, 1000 Crofton La., Buffalo Grove, IL (US) 60089

( * ) Notice: Subject to any disclaimer, the term of this patent is extended or adjusted under 35 U.S.C. 154(b) by 0 days.

(21) Appl. No.: 09/432,676

(22) Filed: Nov. 2, 1999

(51) Int. Cl.[7] ..... F21S 6/00
(52) U.S. Cl. ..... 362/123; 362/249; 362/252
(58) Field of Search ..... 362/123, 249, 362/252, 806

(56) References Cited

U.S. PATENT DOCUMENTS

| | | | |
|---|---|---|---|
| 2,047,045 | | 7/1936 | Paterson . |
| 2,453,695 | | 11/1948 | Belling . |
| 3,770,951 | | 11/1973 | Corelli et al. . |
| 4,099,824 | | 7/1978 | Schoppelrey . |
| 4,720,773 | | 1/1988 | Ahroni . |
| 4,736,282 | | 4/1988 | Ahroni . |
| 4,870,547 | | 9/1989 | Crucefix . |
| 5,150,963 | | 9/1992 | Hill . |
| 6,062,701 | * | 5/2000 | Hines ..... 362/123 |

* cited by examiner

*Primary Examiner*—Stephen Husar
(74) *Attorney, Agent, or Firm*—John D. Long

(57) ABSTRACT

A festive decorative lighting system for trees which features a collar that encompasses a circular power bus that is connected to a plurality of light strings that protrude through the sides of the collar and radially descend down the sides of the tree to positions remote from the collar. The user places the collar onto the crown of the tree by using a telescopic pole with a hook that reversibly engages a hoop attached to the top of the collar.

18 Claims, 8 Drawing Sheets

FESTIVE DECORATIVE LIGHTING SYSTEM FOR TREES

FIELD OF THE INVENTION

The present invention relates to the field of decorative illumination for trees and the like and more particularly to a new and improved integrated lighting system to permit the rapid, convenient and economical placement of lights and other accessories onto trees and other suitably sized objects.

DESCRIPTION OF PRIOR ART

The practice of illuminating small conifers inside the home during the Christmas season is one that extends from before the time of electrification. Beginning as a regional expression of religious faith, the practice has grown in popularity to the extent that it is now perceived as a secular holiday emulated widely across the globe. As such, the festive illumination of conifers in the home has been extended to other holidays and to public settings such as stores, government buildings, schools, parks, malls, hotels, and stores, as well as in commercial settings such as corporate centers, factories and the alike. The trees can either be indoors or out, artificial or real, and can reach several stories in height.

Trees that are the subject of such public and commercial festive illumination are generally of large girth and height, thus complicating the normal procedure of providing illumination by horizontally wrapping lights strings round the tree. Usually the light string placement procedure in such instances requires a significant amount of time, labor and materials.

Generally, a crew of workers is dispatched to lift and horizontally wrap light strings around the large trees. The size of such trees usually mandates that the workers use lifting and support devices such as ladders, cherry picker trucks, scaffolding and alike to allow the workers to obtain the necessary height for the proper placement of the light strings. Since the horizontally wrapping of light strings requires the workers to frequently dismount, reposition, then remount the lifting and support devices. The time, labor and materials spent by using the present method of light string placement for a large tree results in significant expense for the commercial sponsor of the festive tree illuminations.

Since the beginning of this decorative practice, inventors have striven to make apparati that would relieve participants from the tedious and time consuming festive illumination of trees.

In response, numerous inventions have attempted to simplify and improve the process of lighting Christmas trees, such examples include lighting systems that have been known which provide a plurality of dependent strings of lamps connected in series, or in parallel, which are coordinated through a central ring or collar that is placed on the crown or trunk of the tree. Known systems are disclosed in U.S. Pat. No. 4,870,547, Crucefix and U.S. Pat. No. 4,736,282, Ahroni, U.S. Pat. No. 4,720,773, Ahroni, and U.S. Pat. No. 4,099,824, Schoppelrey, U.S. Pat. No. 3,770,951, Correlli, deceased et al.

These devices however are generally designed for home use for indoor Christmas trees of for limited use for outdoor trees of modest to small stature; and construction materials which will not endure outdoor or repeated use. In particular, none of the prior art discloses placement system that allows simple placement upon and removal from trees of a large or multistory stature, or incorporates structure which allows the invention to stand on its own in emulation of a tree shape.

SUMMARY OF THE INVENTION

In light of the foregoing disadvantages revealed under the prior art, the present invention provides a decorative lighting system that in its preferred embodiment comprises of a decorative lighting assembly and a lifting pole. The decorative lighting assembly comprises of a mounting collar with a lifting bracket and a lighting assembly. The mounting bracket comprises of two large light weight plastic hoops held in a parallel planar position relative to one another by evenly spaced plastic spacers. The mounting bracket supports the light assembly which comprises of a circular power bus and a set light strings connected in parallel to the bus. The light strings pass between the plastic spacers and radiate to a position remote from the mounting bracket. The power bus is connected to a power source remote from the mounting bracket.

In one embodiment of the invention which is used on larger trees, the non-mounting collar ends of each light string of the set are connected to two additional light strings, thereby allowing each light string to form an inverted "Y" shape. This attachment of additional light strings provides greater illumination coverage needed to compensate for the additional height and girth of larger trees.

The lifting pole which is expandable, and in the preferred form telescopic, has a hook assembly at one end which reversibly engages the lifting bracket. The user grasps the lifting pole at the non-hook end and then positions the hook to reversibly engage the lifting bracket and to lift the mounting bracket and light assembly upward. The user positions the pole so as to place the mounting collar at or near the crown of the tree so that the mounting bracket surrounds so the trunk of the tree crown. Once the mounting collar is in place, the user then detaches the poles from the lifting bracket and then proceeds to position the light strands down the side of the tree in positions to provide for uniform illumination of the tree.

In another embodiment, the mounting collar is placed over the hook end of lifting pole to allow the hook to engage the lifting bracket. The user then lifts the pole into a full upright position and securely locates the non-hook end of the pole into the ground or a base. The light strings and pole are of sufficient respective length and height so as to allow the light strings to be radially disposed remotely from the mounting collar by suitably securing the non-mounting collar ends of the light strings to the ground. The light strings are secured to the ground at their non-mounting collar ends by being tied stakes plated in the ground. The light strings are positioned and secured so that their overall combined outline is a conical shape generally emulating that of a Christmas tree.

It is an object of this invention is to provide a decorative lighting system that may be used on large trees and other suitable large plant life, the placement and removal of which is simple, economical, and facile thereby permitting the rapid and inexpensive illumination of the subject matter.

It is a further object of the invention to reduce the need for lifting and support platforms traditionally needed for commercial festive illumination of large trees, thereby reducing associated expense and possible worker exposure to injuries from falling off such platforms.

It is a further object of the invention to reduce amount of manpower and associated expense traditionally needed for commercial festive illumination of large trees.

It is another object of this invention is to provide a decorative lighting system that is composed of a lightweight synthetic hoop that supports a system of interconnected light strings which can be placed on top of taller trees or similar structures through the use of an expandable pole that features a hook attachment system.

Another object of this device is to provide a decorative lighting system that can incorporate a decorative accessory which may be located at or near the top of the lifting bracket examples of such accessory would include, but not be limited to, bells or angels or corporate logos or any other accessory of suitable size, shape and composition.

It is another object of this invention to provide a new and improved festive lighting system that is suitable for use with large trees.

It is another object of this invention to provide a new and improved decorative lighting system that may be used to illuminate many objects in addition to Christmas trees.

It is another object of this invention is to provide a decorative lighting system that can be erected as a stand alone device that when light, has an overall conical illumination shape that resembles the that of a Christmas tree.

DESCRIPTION OF THE PREFERRED EMBODIMENT

Figure 1:
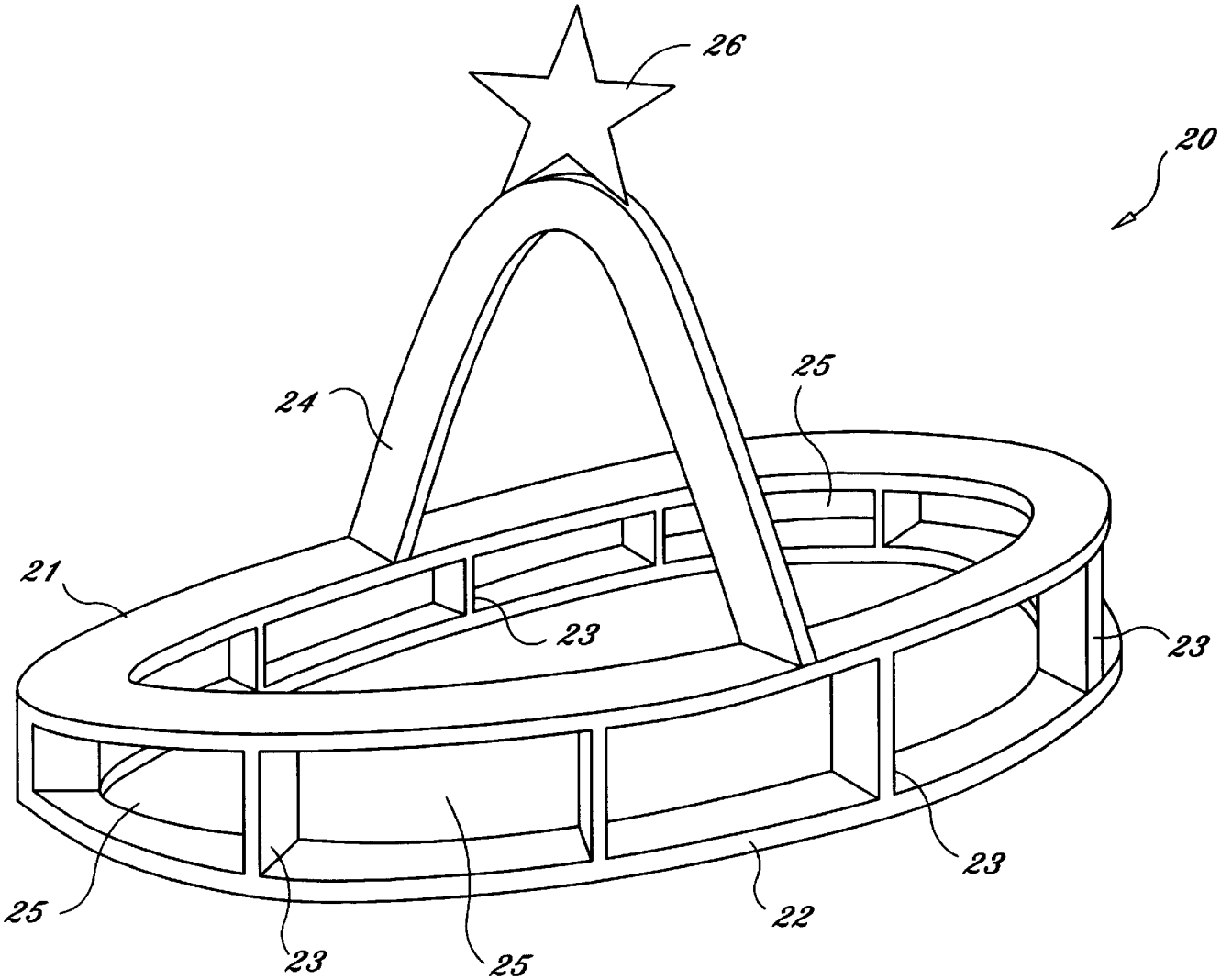
FIG. 1 is a perspective view of the mounting collar.
Figure 2:
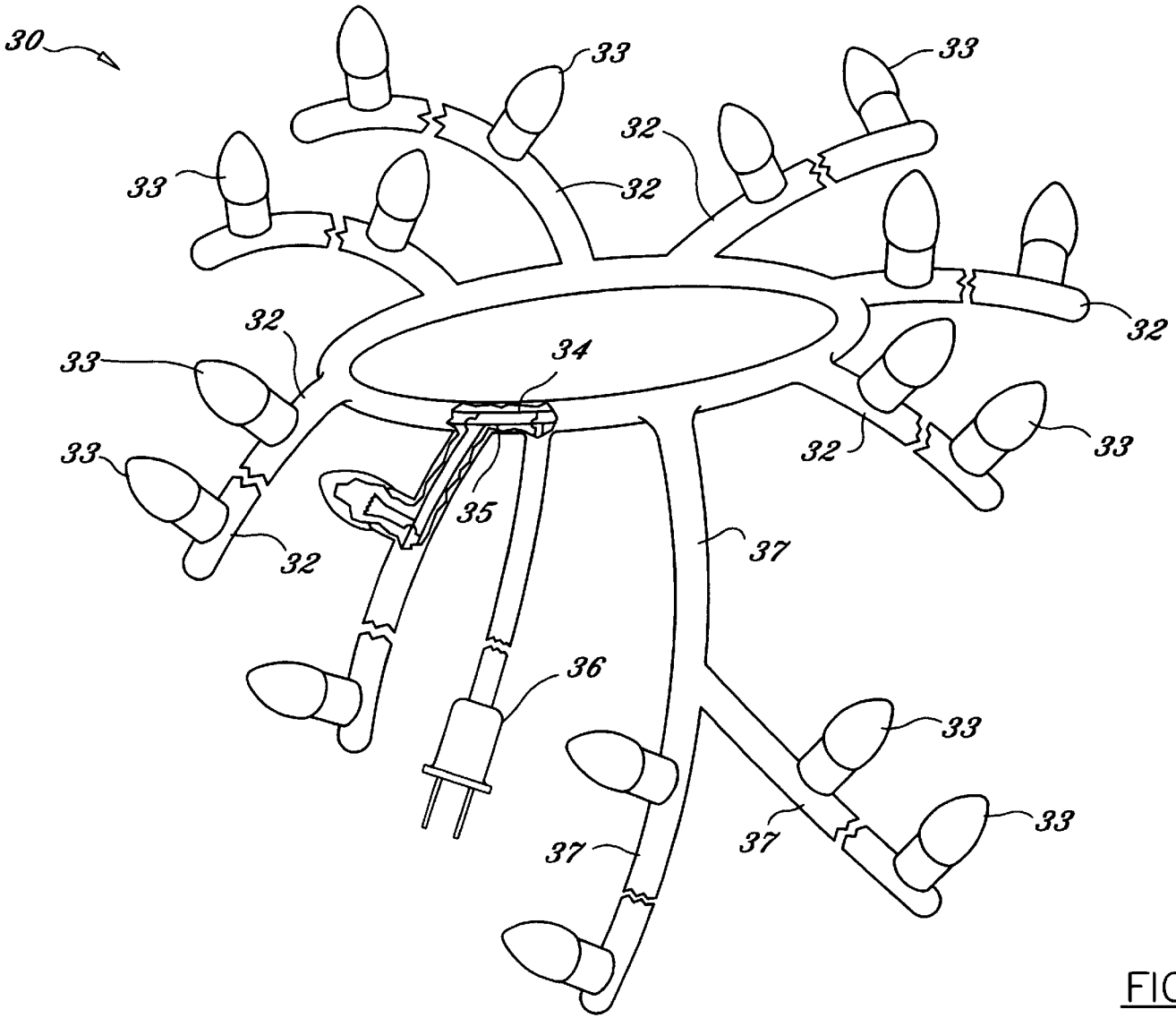
FIG. 2 is a perspective view of the lighting assembly.
Figure 3:
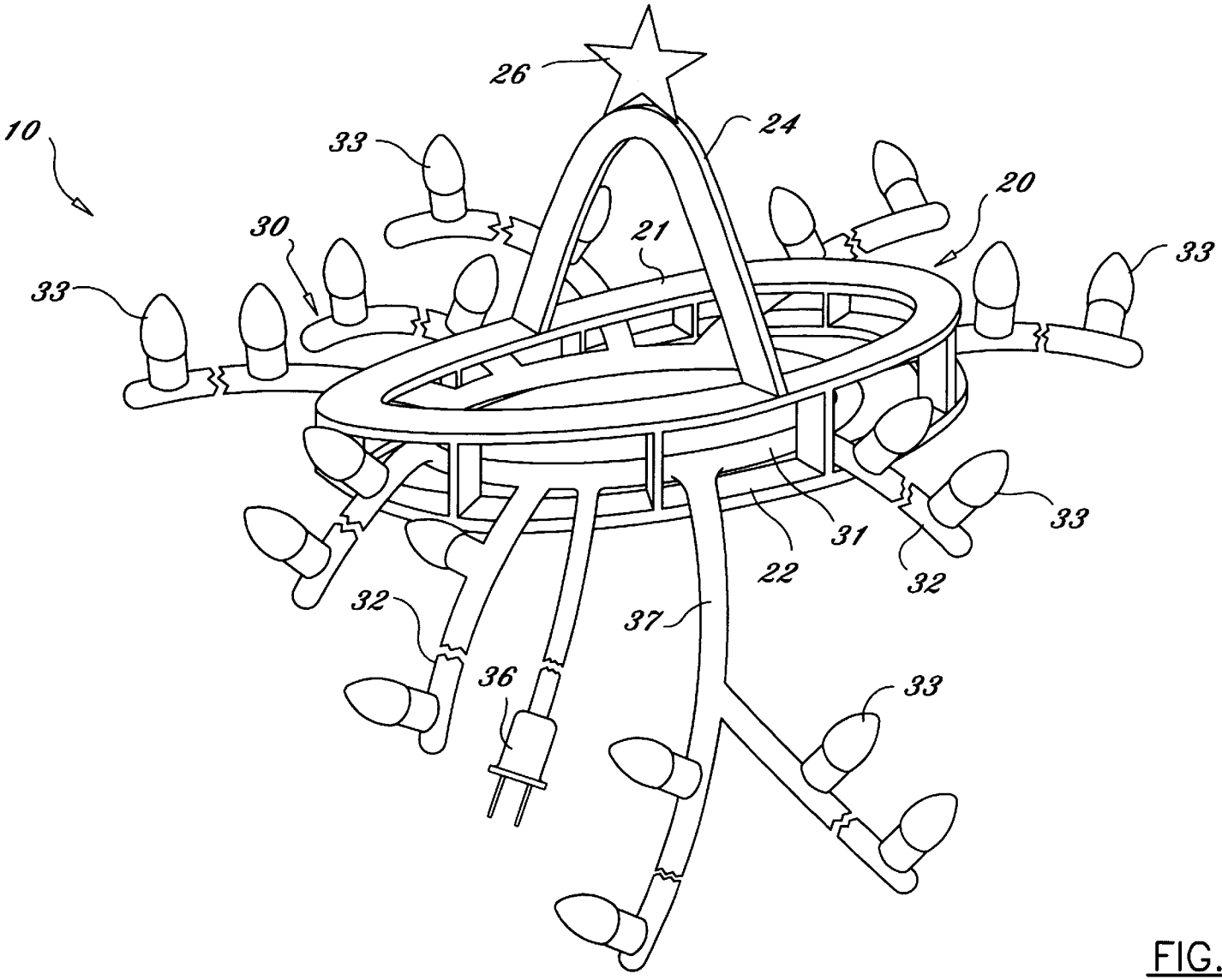
FIG. 3 is a perspective view of the decorative lighting assembly.

With reference now to the drawings, and in particular, to FIGS. 1, 2 and 3 which shows the invention, generally indicated as 1, comprising of a decorative illumination assembly 10 and a lifting pole 40. The decorative illumination assembly 10 is comprised of a mounting collar 20 which supports a lighting assembly 30. The mounting bracket is formed by two rings, a top ring 21 and a bottom ring 22 that are connected to one another by spacers 23 that hold the two rings in a parallel planar position relative to one another. The spacers 23 are evenly placed between the two rings and are connected to the bottom of the top ring 21 and to the top of the bottom ring 22. The inner circumference of the mounting collar 20 of the which is designed to accommodate the trunk 51 of the tree 50 at its crown 52. Attached to the top ring 21 is a inverted "U" shaped lifting bracket 24 that has each end of the "U" fastened the top surface of the top ring 21 at positions 180 degrees apart. A decorative accessory 26, such as a star, an advertisement, or a novelty item may be attached to the top of the lifting bracket 24. The decorative accessory 26 may be electrified and motorized. The mounting collar can be is made of a suitable lightweight polymer such as plastic through injection molding, but in the preferred embodiment it is made of plastic covered wire.

The lighting assembly 30 is comprised of a common power bus ring 31 that is connected in parallel to a plurality of discrete strings 32 of lighting elements 33. Radially centered within the power bus ring 31 are two conductor rings 34 and 35, which are electrically attached to a connector element such as a common two-prong plug 36. The power bus ring 31 in connection to the plug 36 may encompass a suitable fuse or circuit breaker system to prevent damage in case of an electrical short or other electrical overload as are well known to the practitioners in the field.

Each string 32 is electrically connected at one terminal ends to the two conductor rings 34 and 35 with a free terminal end that is remotely locatable. Each string 32 is uniformly spaced from one another where they are attached to the power bus ring 31 and have uniformly spaced standardized lighting elements 33. The lighting elements 33 are electrically connected in parallel of each string 32 to help prevent one burnt out lighting element 33 from breaking the electrical connection for the other lighting elements 33 on that string 32. The strings 32 are to be in several feet in length with each string 32 possessing a remotely locatable free end to facilitate the progressive remote placement of each successive located lighting element 33 from the mounting collar 20. The lighting elements should be used are those standard UL listed outdoors decorative light bulbs such as the General Electric GE C7-CC or C7-TW bulbs. Standard size strings could contain up to 75 bulbs with longer strings being constructed using conductors and strings made of heavier gauge wire to handle the electrical load as in accordance with electrical principles that are well known to the practitioner of the arts.

An alternative embodiment of the light string, would have one string connected to the power bus at one terminal end, then be electrically connected at its other terminal end to two other distinct strings, not otherwise connected to the power bus. In this fashion so that the joined strings forming inverted "Y" shape light string 37 with the foot of the "Y" being the terminal end of the string connected to the power bus ring 31.

In construction with the mounting collar 20, the power bus ring 31 is of sufficient diameter so that its circumference closely matches the inner diameter of the mounting collar 20 so the power ring snugly fits against the inner circumference of the mounting collar. The strings 32 protrude from the power bus ring and pass through the apertures 25 in the mounting collar 20 formed by the spacers 23. In the preferred embodiment, the number of apertures 25 are matches the number of strings, with each string passes through a single aperture with the aperture size and string diameter being mutually compatible. In an alternate embodiment of the invention 1, it is foreseen that large spacers may be used to enhance the structural integrity of the mounting collar 20 for larger trees so that the size of the resulting aperture 25 could accommodate several strings passing through it.

Figure 4:
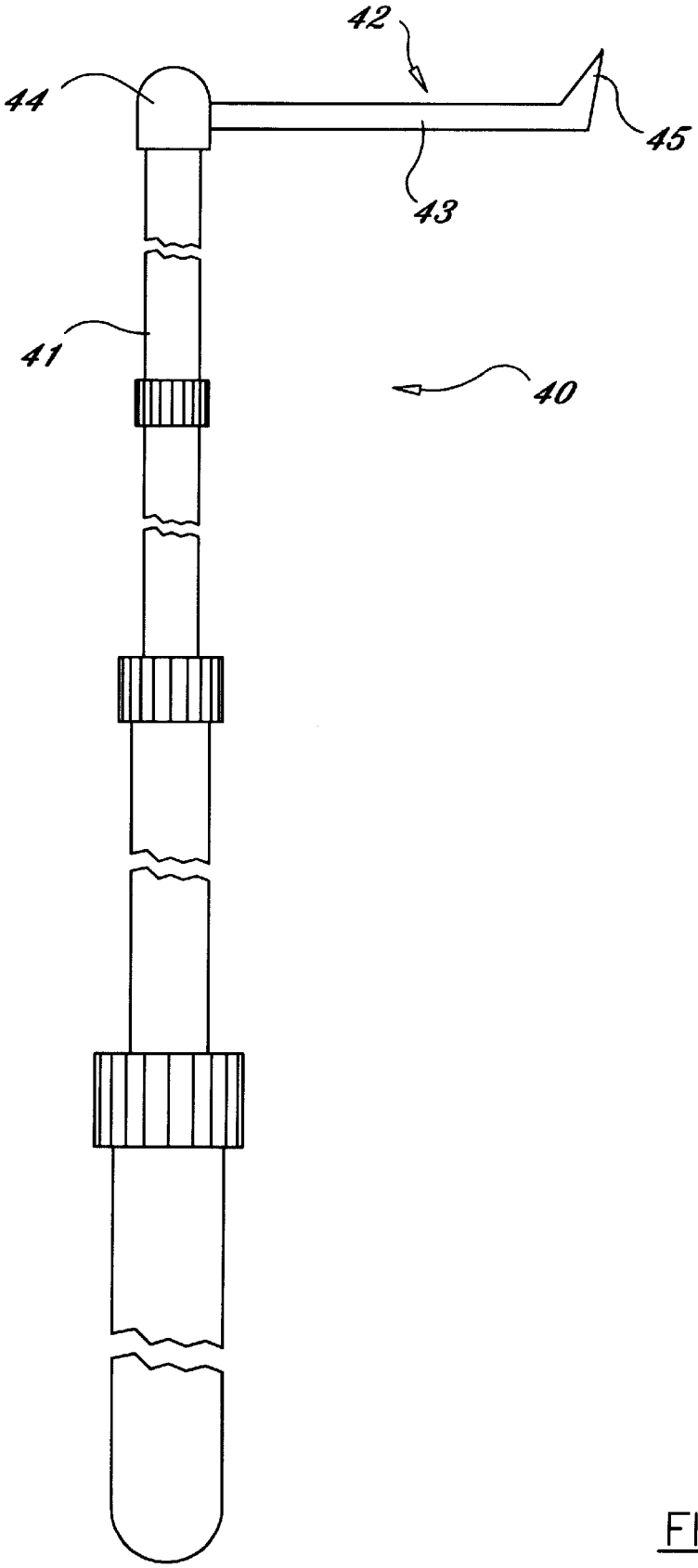
FIG. 4 is a pictorial overview of the lifting pole.

FIG. 4 shows an overview of the lifting pole 40 of the present invention comprising a Pole body 41 and a hook assembly generally referred to as 42. The pole body 41 is expandable, in the preferred embodiment a telescopic aluminum pole like those used by professional window washers. The pole body 41 could also be expandable by the attachable segment. Alternatively, the pole body 41 could be of solid unitary construction made out of some lightweight material such as wood or plastic. At one end of the pole is attached by fastener or appropriate means is the hook assembly 42.

The hook assembly 42 is comprises of a rigid arm 43 that has a cap 44 at one end that fastened over the top end of the pole body 41 and a hook 45 at the unattached end of the rigid arm 43. The rigid arm 43 projects form the cap 44 at a 90-degree angle from the pole body 41. The hook 45 is perpendicularly attached to the rigid arm 43 and extends upward, parallel to the pole body 41. The rigid arm 43 and hook 45 are, respectively, of suitable length and height to reversibly engage and hold the lifting bracket 24 during the positioning of the decorative illumination assembly 10. The hook assembly 42 may be constructed of plastic or some other suitable material as insulated coated metal.

Figure 5:
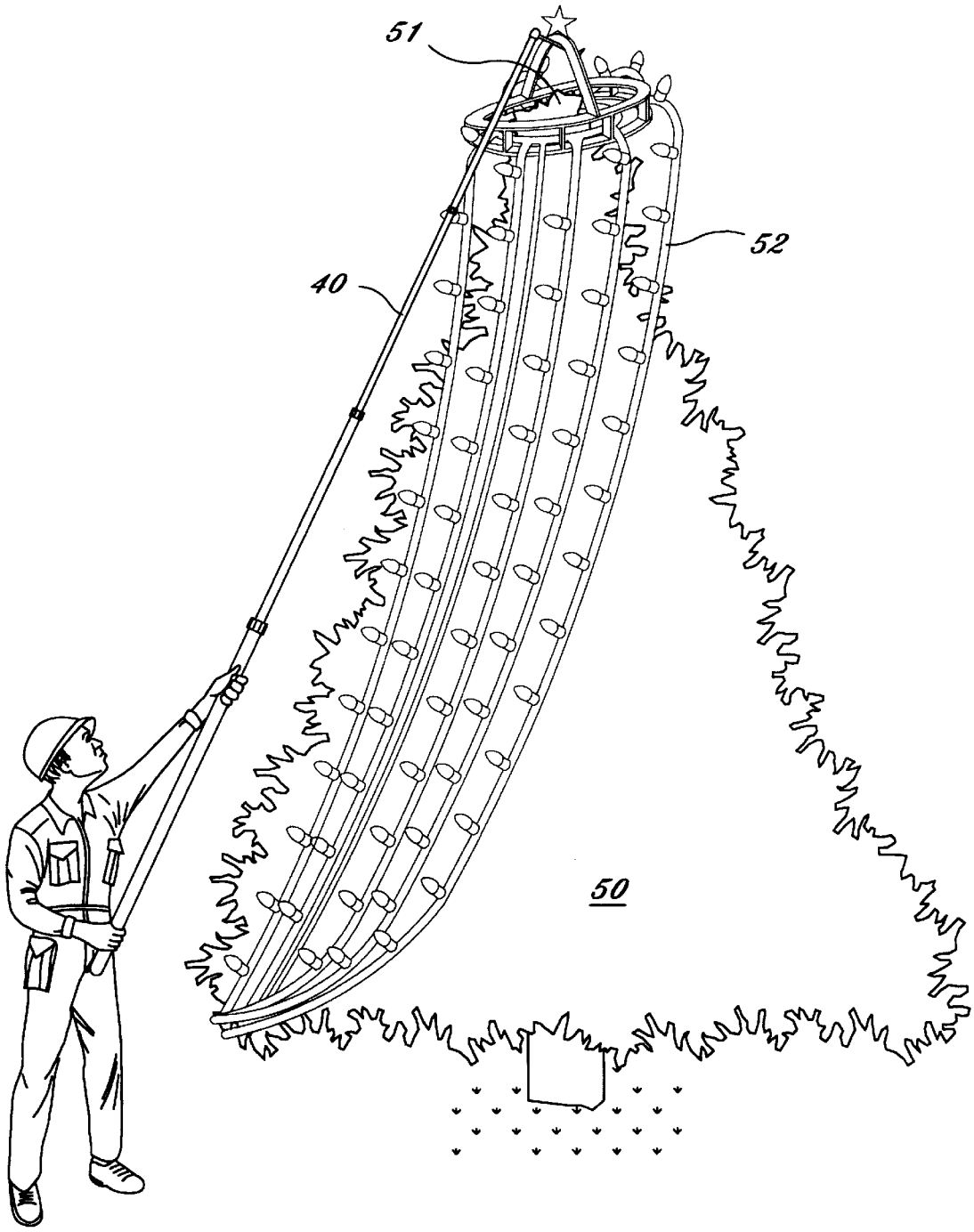
FIG. 5 is a perspective view showing the operator using the lifting pole to position and place the decorative lighting assembly on to a tree.
Figure 6:
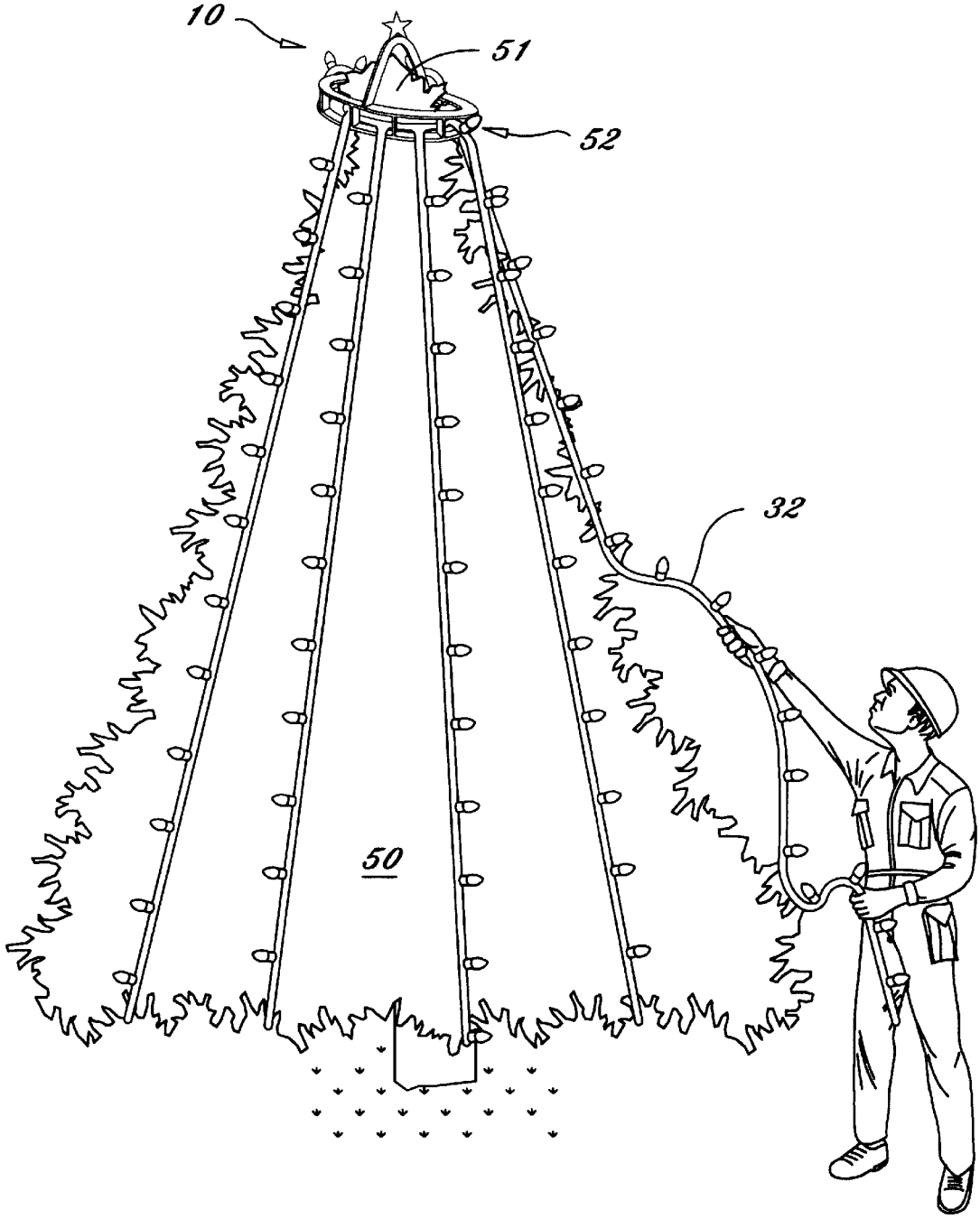
FIG. 6 is a perspective view showing the operator placing the strands once the decorative lighting assembly is mounted on the tree.

FIGS. 5 & 6 demonstrates the operation of the invention, wherein the operator either expands or selects the lifting pole 40 of suitable length to be able to place the decorative light assembly 10 on the crown 52 of the tree 50. The operator then guides the pole 40 so that the hook assembly 42 is placed under the lifting bracket 24 and then lifts the pole so that the lifting bracket is caught in the crook between the hook 45 and the rigid arm 43. The operator continues to lift the pole 40 and the decorative lighting assembly 10 to place the mounting collar 20 so that it surround the trunk 51 of the tree 50 at its crown. At that point, the operator drops the pole 40 down to disengage the hook assembly 42 from the lifting bracket 24. The operator then places the remote terminal of the strings 32 in positions on the tree remote form the mounting collar 20 to effect a uniform pattern of illumination for the tree 50. The operator then electrifies the invention by connecting the plug 36 into a remote power source.

Figure 7:
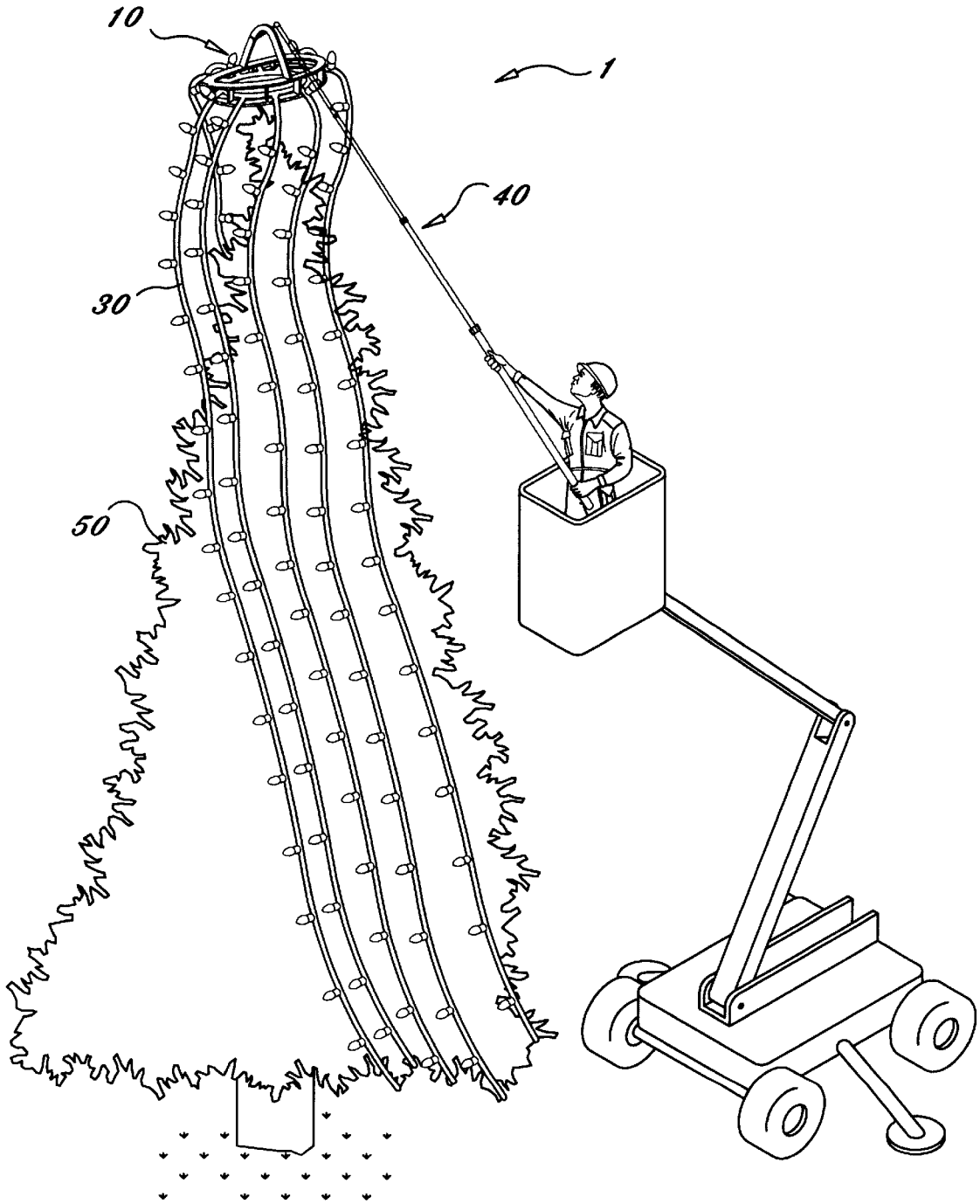
FIG. 7 is a perspective view showing the operator in a cherry picker device mounting the decorative light assembly on a very large tree.
Figure 8:
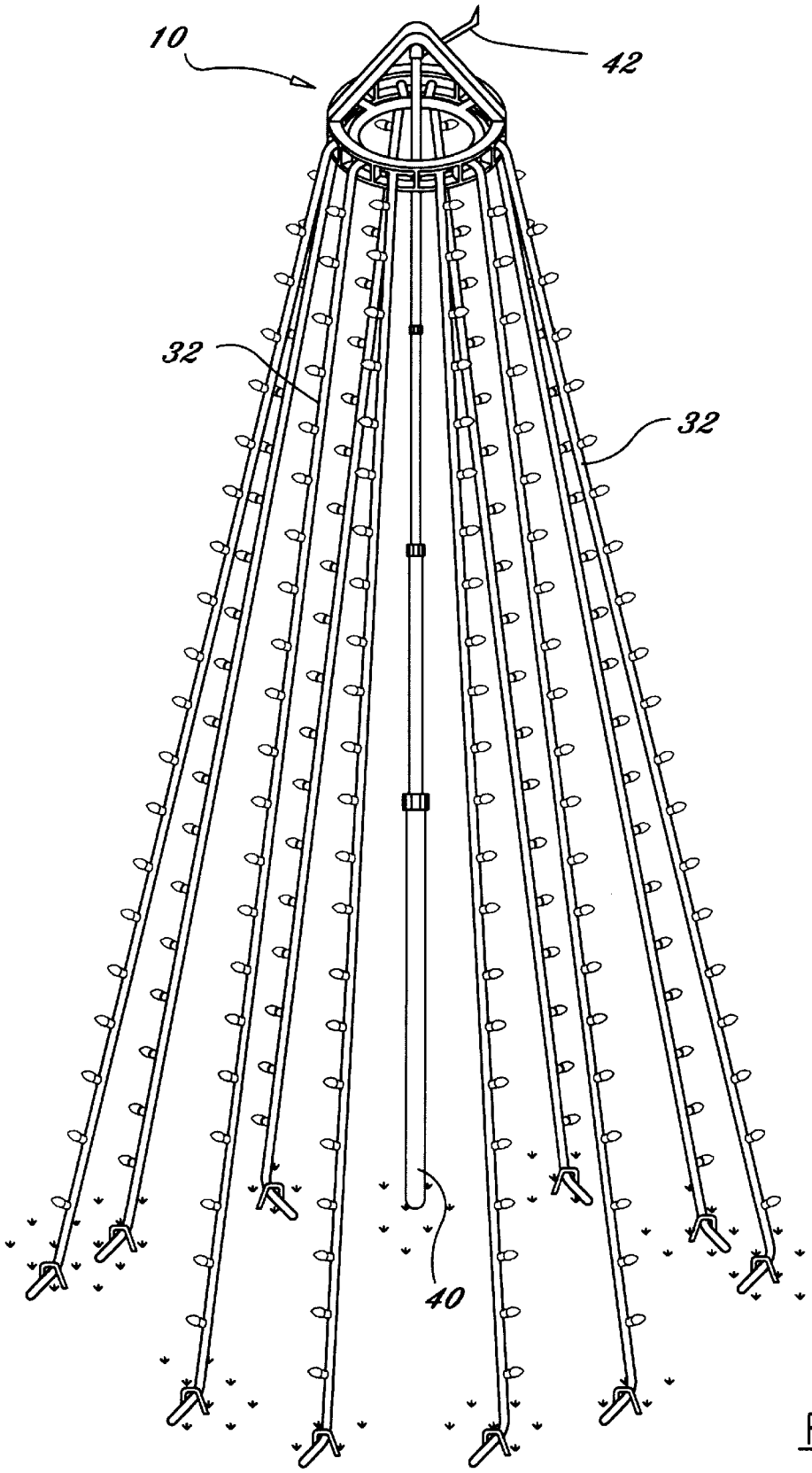
FIG. 8 is a perspective view of the another embodiment of the invention showing its stand-alone display emulating the cone shape of a Christmas tree.

FIG. 7, shows in cases, of very large trees, a cherry picker lifting device can be used to give the operator sufficient height needed to place the decorative illumination assembly 10.

FIG. 9 shows an alternative embodiment of the invention which features the invention 1 in a stand-alone display. In this embodiment, the operator places the mounting collar 20 over the hook assembly 42 of lifting pole 40 to allow the hook 45 to engage the lifting bracket 24. The user then lifts the pole 40 into a full upright position and securely locates the non-hook end of the pole 40 into the ground or a base. The strings 32 and pole 40 are of sufficient respective length and height so as to allow the strings 32 to be radially disposed remotely from the mounting collar by suitably securing the remotely free terminal ends of the light strings to stakes planted in the ground. The light strings are positioned and secured so that their overall combined outline is a conical shape generally emulating that of a Christmas tree. The strings are of sufficient tensile strength to hold the pole in place. The plug 36 is electrically connected to a remote power source to provide electricity to the invention.

The foregoing is considered illustrative of the principles and general intent of the invention. As numerous alterations, modifications and changes will easily occur with those skilled in the art, the foregoing is not to act as a limitation upon the invention as to its exact construction and operation shown and described, accordingly, all suitable and appropriate modifications and equivalents may be resort to that arise within the scope of the invention.

What is claimed is:

1. A decorative lighting system for trees, for placement and securing of the decorative illumination assembly at the crown of the tree of suitable size and stature comprising of:

a) a decorative illumination assembly comprising of:
  i) a mounting collar with a lifting bracket attached, the mounting collar having an interior circumference of sufficient size to accommodate the crown of the tree, the mounting collar further comprising of
    A) two rings that are connected to one by another spacers that are evenly placed between the rings so as to hold the two rings in parallel planar relationship to one and other forming evenly spaced apertures between the two rings;
  ii) a set of distinct strings of pluralities of connected light elements terminally connected to a common toroidal power bus, the toroidal power bus and the plurality of distinct strings being supported by and descending from the mounting collar, b) a lifting pole which reversible engages the lifting bracket for placement and positioning of the invention upon the tree to be illuminated.

2. A decorative lighting system for trees of claim 1 wherein each distinct string protrudes through single aperture of mounting collar.

3. A decorative lighting system for trees of claim 1 wherein the toroidal power bus has a circumference that closely matches the inner circumference of the mounting collar.

4. A decorative lighting system for trees of claim 3 wherein the toroidal power bus is connected to a power source remote from the mounting collar.

5. A decorative lighting system for trees of claim 1 wherein the plurality of distinct strings is electrically connected in parallel.

6. A decorative lighting system for trees of claim 1 wherein the plurality of light elements strings are electrically connected in parallel.

7. A decorative lighting system for trees of claim 1 wherein the rings are of unequal size.

8. A decorative lighting system for trees of claim 1 wherein the rings are of equal size.

9. A decorative lighting system for trees of claim 2 wherein the mounting bracket is constructed out of a plastic coated metal wire frame.

10. A decorative lighting system for trees of claim 1 wherein the pole is telescopic.

11. A decorative lighting system for trees of claim 1 wherein the pole has a hook at one end of the pole.

12. A decorative lighting system for trees of claim 1 wherein the strings have a terminal end remotely positionable from the mounting collar.

13. A decorative lighting system for trees, for placement and securing of the decorative illumination assembly at the crown of the tree of suitable size and stature comprising of:

a) a decorative illumination assembly comprising of:
  i) a mounting collar with a lifting bracket attached, the mounting the mounting collar further comprising of:
    A) two rings that are connected to one by another spacers that are evenly placed between the rings so as to hold the two rings in parallel planar relationship to one and forming other evenly spaced apertures between the two rings;
  ii) a set of distinct strings of pluralities of connected light elements terminally connected to a common toroidal power bus, the toroidal power bus and the plurality of distinct strings being supported by and descending from the mounting collar, the plurality of distinct having free remote terminal ends that are secured to the ground;

b) a lifting pole which at one end reversible engages the lifting bracket for placement and is placed into a full upright position and with the other end is securely planted in to the ground of the invention upon the tree to be illuminated.

14. A decorative lighting system for trees of claim 13 wherein the plurality of distinct strings are positioned and secured to emulate the conical outline of a Christmas tree.

15. A decorative lighting system for trees of claim 13 wherein each distinct string protrudes through single aperture of mounting collar.

16. A decorative lighting system for trees of claim 13 wherein the toroidal power bus has a circumference that closely matches the inner circumference of the mounting collar.

17. A decorative lighting system for trees of claim 13 wherein the toroidal power bus is connected to a power source remote from the mounting collar.

18. A decorative lighting system for trees of claim 13 wherein the pole is telescopic.

* * * * *